US011028668B2

(12) United States Patent
Gallo et al.

(10) Patent No.: US 11,028,668 B2
(45) Date of Patent: Jun. 8, 2021

(54) REDUCING EROSIONAL PEAK VELOCITY OF FLUID FLOW THROUGH SAND SCREENS

(71) Applicants: Federico G. Gallo, Houston, TX (US); Jason Y. Wang, Spring, TX (US); Christian S. Mayer, Pearland, TX (US)

(72) Inventors: Federico G. Gallo, Houston, TX (US); Jason Y. Wang, Spring, TX (US); Christian S. Mayer, Pearland, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 120 days.

(21) Appl. No.: 16/432,171

(22) Filed: Jun. 5, 2019

(65) Prior Publication Data

US 2020/0024928 A1 Jan. 23, 2020

Related U.S. Application Data

(60) Provisional application No. 62/700,018, filed on Jul. 18, 2018.

(51) Int. Cl.
*E21B 34/06* (2006.01)
*E21B 43/08* (2006.01)

(52) U.S. Cl.
CPC ..... *E21B 34/06* (2013.01); *E21B 43/086* (2013.01); *E21B 43/084* (2013.01); *E21B 43/088* (2013.01)

(58) Field of Classification Search
CPC ..... E21B 43/08; E21B 43/082; E21B 43/084; E21B 43/086; E21B 43/088; E21B 34/06
See application file for complete search history.

(56) References Cited

U.S. PATENT DOCUMENTS

2009/0218101 A1* 9/2009 Langlais ..... E21B 43/08 166/313
2011/0247813 A1 10/2011 Moen
2013/0092391 A1* 4/2013 Greene ..... E21B 43/08 166/369
2014/0262260 A1 9/2014 Mayer et al.

FOREIGN PATENT DOCUMENTS

WO WO 2013/184123 A1 12/2013
WO WO 2015/195068 A2 12/2015
WO WO 2016/186650 A1 11/2016

* cited by examiner

*Primary Examiner* — David Carroll
(74) *Attorney, Agent, or Firm* — ExxonMobil Upstream Research Company—Law Department

(57) ABSTRACT

A method of reducing erosional peak velocity includes arranging a sand control screen assembly in an open hole section of a wellbore, the sand control screen assembly including a base pipe defining a plurality of flow ports, a sand screen arranged about the base pipe, and a wellbore isolation device deployed within an annulus defined between the sand control screen assembly and an inner wall of the wellbore. A fluid from a surrounding subterranean formation is circulated within the annulus, and the fluid within the annulus is diverted through the sand screen and into the base pipe upon approaching the wellbore isolation device. A peak velocity of the fluid flowing through the sand screen is reduced with a peak flux reducing assembly arranged axially adjacent the wellbore isolation device.

18 Claims, 4 Drawing Sheets

REDUCING EROSIONAL PEAK VELOCITY OF FLUID FLOW THROUGH SAND SCREENS

CROSS-REFERENCE TO RELATED APPLICATION

This application claims the benefit of U.S. Provisional Patent Application 62/700,018 filed Jul. 18, 2018, the entirety of which is incorporated by reference herein.

BACKGROUND

In the oil and gas industry, hydrocarbons can be produced from subterranean formations penetrated by a wellbore. Efficient control of the movement of unconsolidated formation particles into the wellbore, such as sand or other debris, has always been a pressing concern. Such formation movement commonly occurs during production from completions in loose sandstone or following hydraulic fracturing operations. Formation movement can also occur when a section of the wellbore collapses, which causes significant amounts of particulates and fines to circulate into the adjacent wellbore. Drawing formation particles into wellbore production equipment can cause numerous problems, such as plugging production tubing and subsurface flowlines and the eventual erosion of flowlines, valves, downhole pumps, and fluid separation equipment at the surface.

To control the migration of formation particles into wellbore production equipment, sand control screen assemblies are often installed downhole across formations. A typical sand control screen assembly includes a screen made of wire or metal wrapped about a perforated base pipe. Sand control screen assemblies allow fluids to flow therethrough and into the base pipe but prevent the influx of particulate matter of a predetermined size and greater.

The effectiveness of a sand control screen assembly can be augmented, particularly in open-hole completions, by installing a gravel pack in the wellbore annulus surrounding the sand control screen assembly within the wellbore. If a gravel pack is not used, however, sand control screen assemblies may nonetheless be used and are commonly referred to as "stand-alone screens." Stand-alone screens are exposed to the open wellbore annulus and are, therefore, more susceptible to erosion damage during well production. When a stand-alone screen is installed in a high-pressure, high-productivity formation having high permeability streaks, the sand screen can be particularly vulnerable to failure due to sand erosion.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to the field of well completions and downhole operations. More specifically, the present invention relates to a sand control device, and methods for conducting wellbore operations using a downhole fluid filtering device.

The ability of a sand screen to resist erosion due to particulates suspended in the fluid flowing therethrough is strongly linked to the velocity of the flow transporting the particles. The velocity of the flow, combined with the quantity of particles present in the stream, are the most relevant quantities when it comes to evaluating the life of sand screens and any reduction in either of the two will produce considerable gains in usable life of the screen. Due to the dynamics of fluid flow in a wellbore, a high velocity of entry through a sand screen is commonly experienced near areas where annular flow (i.e., flow along the wellbore in the annulus defined between the sand screen and the wellbore wall) is interrupted, such as at a wellbore isolation device (e.g., a wellbore packer). This high velocity greatly accelerates the erosion of the sand screen in this location and, if not mitigated, can reduce the risk of early failure of the sand screen.

The embodiments discussed herein describe methods of reducing erosional peak velocity of fluid flow through sand screens of a sand control screen assembly. The sand control screen assembly may be arranged in an open hole section of a wellbore and may include a base pipe defining a plurality of flow ports, a sand screen arranged about the base pipe, and a wellbore isolation device deployed within an annulus defined between the sand control screen assembly and an inner wall of the wellbore. A fluid from a surrounding subterranean formation may be circulated within the annulus, and the fluid within the annulus may be diverted through the sand screen and into the base pipe upon approaching the wellbore isolation device. A peak velocity of the fluid flowing through the sand screen may be reduced with a peak flux reducing assembly arranged axially adjacent the wellbore isolation device.

Figure 1:
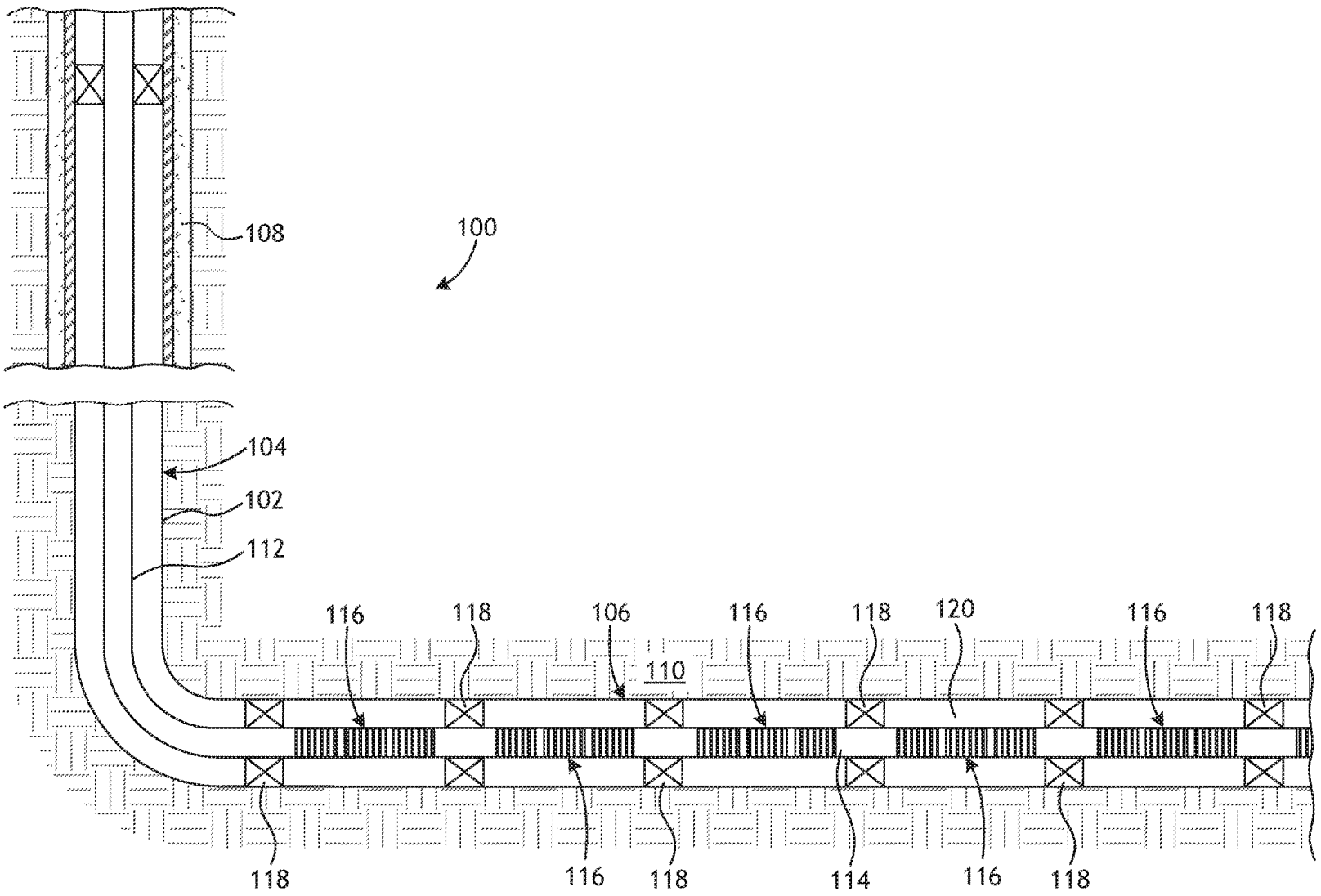
FIG. 1 is an example well system that may employ one or more principles of the present disclosure.

FIG. 1 is an example well system 100 that may employ one or more principles of the present disclosure, according to one or more embodiments. As depicted, the well system 100 includes a wellbore 102 that extends through various earth strata and has a substantially vertical section 104 extending to a substantially horizontal section 106. The upper portion of the vertical section 104 may have a string of casing 108 or another type of wellbore liner cemented therein, and the horizontal section 106 may extend through a hydrocarbon-bearing subterranean formation 110. In at least one embodiment, the horizontal section 106 may comprise an open hole section of the wellbore 102.

A tubing string 112 may be positioned within the wellbore 102 and extend from the surface (not shown). In production operations, the tubing string 112 provides a conduit for fluids extracted from the formation 110 to travel to the surface. In injection operations, the tubing string 112 also provides a conduit for fluids introduced into the wellbore 102 at the surface to be injected into the formation 110. At its lower end, the tubing string 112 may be coupled to a completion string 114 positionable within the horizontal section 106. The completion string 114 may help divide the completion interval into various production intervals across the formation 110.

As depicted, the completion string 114 may include a plurality of sand control screen assemblies 116 axially offset from each other along portions of the completion string 114. Each sand control screen assembly 116 may be positioned between a pair of wellbore isolation devices 118 (alternately referred to as "packers" or "wellbore packing devices") that provides a fluid seal between the completion string 114 and the inner wall of the wellbore 102, thereby defining corresponding production intervals. In operation, the sand control screen assemblies 116 serve the primary function of filtering particulate matter out of the production fluid stream such that particulates and other fines are not produced to the surface via the tubing string 112.

According to embodiments of the present disclosure, portions of the annulus 120 defined between the sand control screen assemblies 116 and the wall of the wellbore 102, and longitudinally between adjacent wellbore isolation devices 118, may remain open and otherwise not packed with gravel or sand (i.e., not gravel packed). Such portions of the wellbore 102 may be referred to as "open hole" portions, and the sand control screen assemblies 116 positioned in the open hole portions may be referred to as "stand alone screens."

It should be noted that even though FIG. 1 depicts a single sand control screen assembly 116 arranged in each production interval, it will be appreciated that any number of screen assemblies 116 may be deployed within a given production interval without departing from the scope of the disclosure. In addition, even though FIG. 1 depicts multiple production intervals separated by the wellbore isolation devices 118, it will be understood by those skilled in the art that the completion interval may include any number of production intervals with a corresponding number of wellbore isolation devices 118 arranged therein.

Moreover, while FIG. 1 depicts the screen assemblies 116 as being arranged in the horizontal section 106 of the wellbore 102, the screen assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
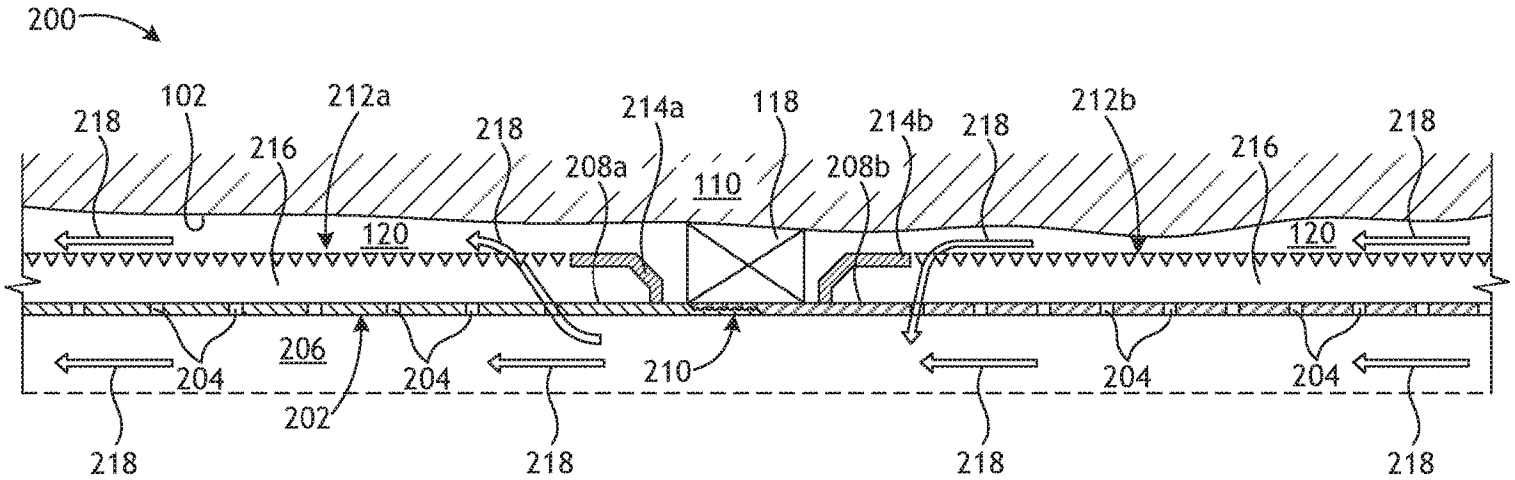
FIG. 2 is a cross-sectional side view of a sand control screen assembly.

FIG. 2 is a cross-sectional side view of a sand control screen assembly 200. The sand control screen assembly 200 (hereafter "the screen assembly 200") may be the same as or similar to any of the sand control screen assemblies 116 of FIG. 1 and may, therefore, be used in the well system 100 depicted therein. The screen assembly 200 may be deployed and otherwise operated in an open hole section of the wellbore 102, where the annulus 120 between the screen assembly 200 and the inner wall of the wellbore 200 is open and otherwise generally free of gravel and/or sand (i.e., not gravel packed). Consequently, the screen assembly 200 may be referred to or otherwise characterized as a "stand alone screen."

As illustrated, the screen assembly 200 may include or otherwise be arranged about a base pipe 202 that defines one or more openings or flow ports 204 configured to provide fluid communication between an interior 206 of the base pipe 202 and the surrounding formation 110. Accordingly, the base pipe 202 may be characterized as a "perforated" base pipe. The base pipe 202 may form part of the completion string 114 of FIG. 1 and, in at least one embodiment, the screen assembly 200 may be arranged at the end of the completion string 114 and may otherwise comprise the last screen section at or near the toe of the wellbore 102.

In some embodiments, the base pipe may comprise at least two tubular lengths, shown as a first base pipe portion 208*a* and a second base pipe portion 208*b* coupled to the first base pipe portion 208*a* at a pipe joint 210. In the illustrated embodiment, the pipe joint 210 comprise a threaded box-and-pin connection, but may alternatively comprise any other type of tubing connection or connector. The base pipe 202 may be coupled to or form part of the tubing string 112 (FIG. 1) and thereby be able to produce incoming fluids to a surface location for collection via the tubing string 112.

In some embodiments, a wellbore isolation device 118 may be deployed within the annulus 120 at or near the pipe joint 210. In at least one embodiment, the wellbore isolation device 118 may radially interpose the pipe joint 210 and the inner wall of the wellbore 102, thereby providing a fluid seal between the base pipe 202 and the inner wall of the wellbore 102. Moreover, the wellbore isolation device 118 may separate the annulus 120 into upper and lower sections or production intervals.

The screen assembly 200 may further include one or more sand screens arranged about the base pipe 202, shown as a first or upper sand screen 212*a* and a second or lower sand screen 212*b*. As illustrated, the first sand screen may be disposed about the first base pipe portion 208*a* and the second sand screen 212*b* may be disposed about the second base pipe portion 208*b*. The first sand screen 212*a* may extend axially uphole from a first or upper housing 214*a* arranged about the first base pipe portion 208*a*, and the second sand screen 212*b* may extend axially downhole from a second or lower housing 214*b* arranged about the second base pipe portion 208*b*. The first and second housings 214*a,b* (alternately referred to as first and second "end rings") provide a mechanical interface between the base pipe 202 and the corresponding first and second sand screens 212*a,b*.

As illustrated, the sand screens 212*a,b* may each be radially offset a short distance from the outer radial surface of the first and second base pipe portions 208*a,b*, respectively, and thereby define a production annulus 216 therebetween. The radial offset may result from one or more ribs (not shown) interposing the base pipe 202 and the screens 212*a,b* and extending longitudinally along the length of the first and second base pipe portions 208*a,b*. A plurality of ribs may be angularly offset from each other about the circumference of the base pipe 202, and the magnitude (depth) of the production annulus 216 may be dependent on the height of the ribs.

The sand screens 212*a,b* serve as a filter medium designed to allow fluids derived from the formation 110 to flow therethrough, but prevent the influx of particulate matter of a predetermined size and greater. In some embodiments, the sand screens 212*a,b* may be made from a plurality of layers of a wire mesh that are diffusion bonded or sintered together to form a fluid porous wire mesh screen. In other embodiments, however, the sand screens 212*a,b* may have multiple layers of a weave mesh wire material having a uniform pore structure and a controlled pore size that is determined based upon the properties of the formation 110. For example, suitable weave mesh screens may include, but are not limited to, a plain Dutch weave, a twilled Dutch weave, a reverse Dutch weave, combinations thereof, or the like. In other embodiments, however, the sand screens 212*a,b* may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure.

In example operation, fluids 218 from the surrounding formation 110 may be drawn into the annulus 120 and circulated in the uphole direction (i.e., to the left in FIG. 2) within the annulus 120 and the interior 206 of the base pipe 202. The fluid 218 may access the interior 206 by passing through the screens 212*a,b*, entering the production annulus 216, and axially traversing the exterior of the base pipe 202 until locating and entering the flow ports 204, which fluidly communicate with the interior 206 of the base pipe 202. Particulate matter of a size greater than the screen gauge of the sand screens 212*a,b* may be prevented from passing into the production annulus 216 and thus into the interior 206 of the base pipe 202.

Since the screen assembly 200 is positioned in an open hole annulus 120, the fluid 218 will generally flow uphole in both the annulus 120 and the interior 206 of the base pipe 202. When the fluid 218 flowing within the annulus 120 approaches the wellbore isolation device 118 (or any restriction in the annulus 120), however, the fluid 218 is forced to traverse the second screen 212*b* at or near the second housing 214*b* and subsequently enter the base pipe 202 via the flow ports 204 adjacent the second housing 214*b*. Due to the dynamics of fluid flow, the fluid 218 from the annulus 120 is accelerated through the second screen 212*b* at peak velocity at or near the second housing 214*b*, which can cause erosion of the screen 212*b* at this location.

Once bypassing the axial location of the wellbore isolation device 118 within the interior 206 of the base pipe 202, the flow of the fluid 218 will naturally tend to spread out (split) again to reduce (minimize) friction and pressure. Accordingly, a portion of the fluid 218 flowing within the base pipe 202 may return to the annulus 120 by exiting the base pipe 202 and subsequently traversing the first screen 212*a* at or near the first housing 214*a*. The fluid 218 exiting the base pipe 202 and traversing the first screen 212*a* may also be accelerated at peak velocity at or near the first housing 214*b*. Due to the peak velocity of the fluid 218 traversing the screens 212*a,b* at their ends near the housings 214*a,b*, localized fluid "hotspots" may develop and can result in erosional screen failure at these locations.

Embodiments of the present disclosure describe methods and systems of reducing the peak velocity of the fluid 218 entering and exiting the base pipe 202 and otherwise traversing the ends of the screens 212*a,b* at or near the housings 214*a,b*. As described herein a peak flux reducing assembly may be arranged at or adjacent the wellbore isolation device 118 and operate to reduce a peak velocity of the fluid 218 traversing the sand screens 212*a,b* on either side of the wellbore isolation device 118 (e.g., before and/or after). In some embodiments, as described herein, the peak flux reducing assembly may urge the fluid 218 through the screens 212*a,b* at multiple locations and thereby generate multiple fluid hotspots that exhibit reduced fluid velocities as compared to a single fluid hotspot at an end of the sand screen 212*a,b*. In other embodiments, the peak flux reducing assembly may progressively (gradually) reduce the volumetric flow area of the annulus 120 adjacent the ends of the screens 212*a,b*. Progressively reducing the volumetric flow area may urge the fluid 218 to traverse the screens 212*a,b* (either influx or outflow) across a larger axial length of the screens 212*a,b* and thereby spread the volumetric flow over a larger area, which reduces the peak velocity of the fluid 218 traversing the screens 212*a,b*. By reducing the peak velocity of the fluid 218 entering and exiting the base pipe 202 at or near the ends of the screens 212*a,b*, localized erosion of the screens 212*a,b* may be drastically reduced, which may mitigate early failure of the screens 212*a,b*.

Figure 3:
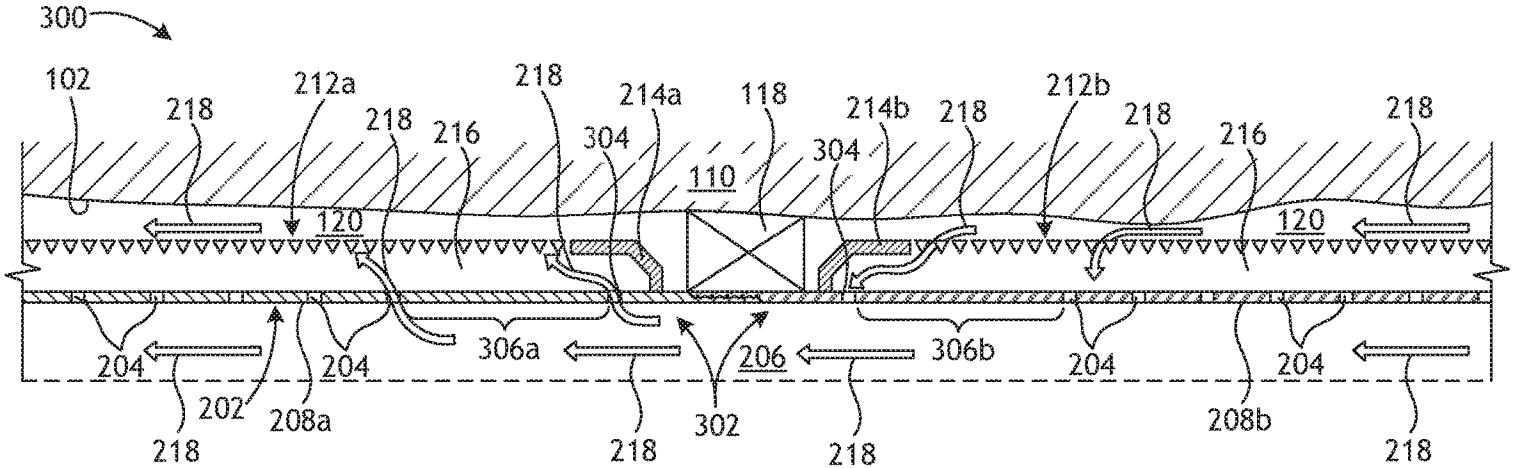
FIG. 3 is a cross-sectional side view of an example sand control screen assembly in accordance with one or more embodiments of the present disclosure.

FIG. 3 is a cross-sectional side view of an example sand control screen assembly 300 in accordance with one or more embodiments of the present disclosure. The sand control screen assembly 300 (hereafter "the screen assembly 300") may similar to the screen assembly 200 of FIG. 2 and, therefore, may be best understood with reference thereto, where like numerals will represent like components not described again. Similar to the screen assembly 200, the screen assembly 300 may replace any of the sand control screen assemblies 116 of FIG. 1 and, therefore, may be used in the well system 100 depicted therein. In at least one embodiment, the screen assembly 300 may be arranged at the end of the completion string 114 (FIG. 1) and otherwise comprise the last screen section at or near the toe of the wellbore 102. Moreover, the screen assembly 300 may be arranged in an open hole section of the wellbore 102, thus making the screen assembly 300 a standalone screen.

Similar to the screen assembly 200 of FIG. 2, the screen assembly 300 includes the base pipe 202 and the sand screens 212*a,b* are arranged about the base pipe 202 and extend axially from the corresponding housings 214*a,b*, respectively. Unlike the screen assembly 200 of FIG. 2, however, the screen assembly 300 may include a peak flux reducing assembly 302 arranged at or axially adjacent the wellbore isolation device 118. The peak flux reducing assembly 302 may be operable to reduce the peak velocity of the fluid 218 traversing one or both of the sand screens 212*a,b* on either side of the wellbore isolation device 118. While described herein as able to reduce the peak velocity of the fluid 218 through both of the sand screens 212*a,b*, the peak flux reducing assembly 302 could alternatively be operable to reduce the peak velocity of the fluid 218 through only one of the sand screens 212*a,b*, without departing from the scope of the disclosure.

As illustrated, the peak flux reducing assembly 302 may include one or more housing flow ports 304 (alternately referred to as "end ring" flow ports) defined in the base pipe 202 radially beneath the first and second housings 214*a,b*. More specifically, the housing flow ports 304 may be defined in the first and second base pipe portions 208*a,b* and the corresponding housings 214*a,b* may be installed over the housing flow ports 304. In some embodiments, multiple housing flow ports 304 may be defined in the base pipe portions 208*a,b* about the circumference thereof and located radially beneath the corresponding housings 214*a,b*, respectively.

The peak flux reducing assembly 302 may further include an impermeable section of the base pipe 202 at the end of each screen 212*a,b* adjacent the housings 214*a,b*. More specifically, the first base pipe portion 208*a* may provide a first impermeable section 306*a* and the second base pipe portion 208*b* may provide a second impermeable section 306*b*, alternately referred to as a "tuned length" impermeable section. As illustrated, the first impermeable section 306*a* may extend between the housing flow port(s) 304 and the flow ports 204 of the first base pipe portion 208*a*. Similarly, the second impermeable section 306*b* may extend between the housing flow port(s) 304 and the flow ports 204 of the second base pipe portion 208*b*.

Each impermeable section 306*a,b* may comprise an axial length of the base pipe 202 that is non-perforated and is otherwise impermeable to fluid flow between the interior 206 and the production annulus 216 of each sand screen 212*a,b*. In some embodiments, as illustrated, at least a portion of each impermeable section 306*a,b* may extend radially beneath a corresponding portion of the sand screens 212*a,b*, respectively. Moreover, in some embodiments, a portion of each impermeable section 306*a,b* may extend radially beneath the corresponding housing 214*a,b*.

In example operation, fluids 218 from the surrounding formation 110 may be drawn into the annulus 120 and then circulated in the uphole direction (i.e., to the left in FIG. 3) within the annulus 120 and the interior 206 of the base pipe 202. Since the screen assembly 300 is positioned in an open hole annulus 120, the fluid 218 will generally flow uphole simultaneously in both the annulus 120 and the interior 206 of the base pipe 202. When the fluid 218 flowing within the annulus 120 approaches the wellbore isolation device 118, the fluid 218 will be forced to traverse the second screen 212*b* to enter the base pipe 202.

The second impermeable section 306*b* may operate to urge the incoming fluid 218 through the second screen 212*b* via multiple flow paths. More specifically, a portion of the fluid 218 may pass through the second screen 212*b* at or near the location of the flow ports 204 nearest the housing flow port 304 in the second base pipe portion 208*b*, and another portion of the fluid 218 may simultaneously pass through the second screen 212*b* at or near the end of the screen 212*b* at the second housing 214*b*. Positioning the housing flow port 304 radially beneath the second housing 214*b* forces the fluid 218 to change fluid flow direction within the production annulus 216 to reach the housing flow port 304. Consequently, since the fluid 218 enters the base pipe 202 at multiple locations, the peak velocity of the fluid 218 may be reduced as compared to fluid flow through a single location.

Once bypassing the axial location of the wellbore isolation device 118 within the interior 206 of the base pipe 202, the flow of the fluid 218 will naturally tend to spread out (split) again to reduce (minimize) friction and pressure. Accordingly, a portion of the fluid 218 may return to the annulus 120 by exiting the base pipe 202 through the first screen 212*a*. The first impermeable section 306*a* may operate to urge a portion of the fluid 218 out of the base pipe 202 via multiple flow paths. More specifically, a first portion of the fluid 218 may flow through the housing flow port 304 beneath the first housing 214*a*, and another portion of the fluid 218 may simultaneously 212*b* flow through the flow ports 204 nearest the first housing 214*a*. Positioning the housing flow port 304 radially beneath the first housing 214*a* forces the fluid 218 to change fluid flow direction within the production annulus 216 to reach the first screen 212*a*. Consequently, the fluid 218 may exit the base pipe 202 at multiple locations, but at reduced peak velocities as compared to fluid flow through a single location.

In some embodiments, the screen assembly 300 may be tuned or otherwise optimized to adjust the influx and outflow of the fluid 218 through the sand screens 212*a,b* at the multiple locations. In at least one embodiment, for example, the size (diameter) of one or both of the housing flow ports 304 may be adjusted (enlarged or reduced). In other embodiments, or in addition thereto, the axial length of the impermeable sections 306*a,b* may be adjusted (elongated or shortened). Adjusting the size of the housing flow ports 304 and/or the length of the impermeable sections 306*a,b* may alter the backpressure of the fluid 218 and thus alter how much fluid 218 flows through the housing flow ports 304, while the rest is diverted through the other flow ports 204.

Adjustments to the size (diameter) of the housing flow ports 304 and/or the length of the impermeable sections 306*a,b* may be based on various known parameters of the screen assembly 300. Example known parameters include, but are not limited to, one or more fluid properties of the fluid 218 (e.g., flow rate, viscosity, etc.), one or more geometric parameters of the well (e.g., diameter of the wellbore 102, etc.), one or more features of the screens 212*a,b* (e.g., size of the screens, height of the ribs, number of flow ports 204 in the base pipe 202, etc.), or any combination thereof.

Figure 4:
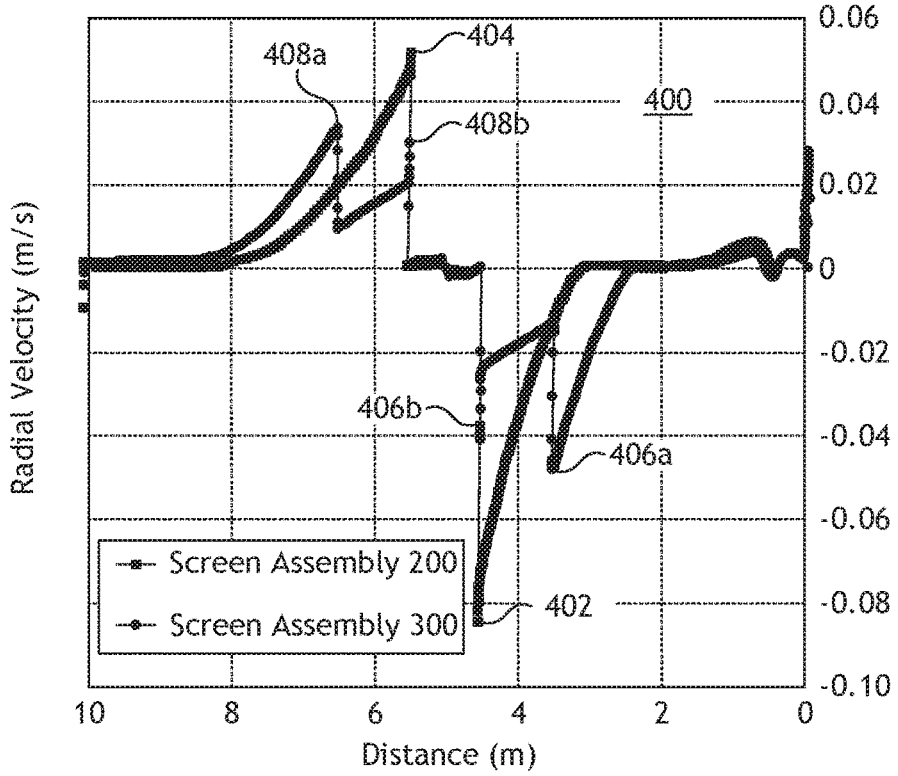
FIG. 4 is a plot comparing fluid flow through a conventional sand control screen assembly with fluid flow through a sand control screen assembly according to the principles of the present disclosure.

FIG. 4 is a plot 400 comparing peak fluid flow velocity through the screen assembly 200 of FIG. 2 and the screen assembly 300 of FIG. 3 that incorporates the principles of the present disclosure. More specifically, the plot 400 tracks and reports the radial velocity of the fluid flow (in meters per second) based on distance (in meters) along the length of the base pipe 202 (FIGS. 2 and 3) for each screen assembly 200, 300. Accordingly, the results of the plot 400 will be best understood with continued reference to FIGS. 2 and 3.

For the screen assembly 200, the radial velocity of the fluid flow is generally zero (moving right to left in uphole fluid flow) until around 3.2 meters, at which point the fluid rapidly accelerates through the second screen 212*b* (FIG. 2) and into the base pipe 202. This rapid fluid acceleration results in a single influx hotspot 402 of the fluid 218 (FIG. 2) through the second screen 212*b* at a radial peak velocity of about −0.085 m/s (negative since flow is into the base pipe 202). Once in the base pipe 202 at or near 4.5 meters, the radial velocity of the fluid 218 drops back to zero until the flow reaches about 5.5 meters, at which point a portion of the fluid 218 again rapidly accelerates, but this time out of the base pipe 202 and through the first screen 212*a* (FIG. 2). This rapid fluid acceleration results in a single outflow hotspot 404 of the fluid 218 through the first screen 212*a* at a radial peak velocity of about 0.05 m/s (positive since flow is out of the base pipe 202).

For the screen assembly 300 that incorporates the peak flux reducing assembly 302 (FIG. 3), in contrast, the radial velocity of the fluid flow is generally zero (moving right to left in uphole flow) until around 2.5 meters, at which point a first portion of the fluid 218 (FIG. 3) accelerates radially through the second screen 212*b* (FIG. 3) and into the base pipe 202 (FIG. 3). This results in a first influx hotspot 406*a* for the fluid 218 through the second screen 212*b* at a radial peak velocity of about −0.045 m/s. Because of the second impermeable section 306*b* (FIG. 3) of the peak flux reducing assembly 302, a second portion of the fluid 218 may also accelerate radially through the second screen 212*b* at about 3.5 meters and passes through the housing flow port 304 (FIG. 3) radially beneath the second housing 214*b* (FIG. 3).

This results in a second influx hotspot 406*b* for the fluid 218 through the second screen 212*b* at a radial peak velocity of about −0.04 m/s.

As with the first screen assembly 200, the radial velocity of the fluid 218 in the second screen assembly 300 drops back to zero until the flow reaches about 5.5 meters, at which point a portion of the fluid 218 again rapidly accelerates, but this time out of the base pipe 202. Because of the first impermeable section 306*a* (FIG. 3), flow out of the base pipe 202 may be split and thus results in a first outflow hotspot 408*a* and a second outflow hotspot 408*b*. The first outflow hotspot 408*a* may be representative of fluid flow through the flow ports 204 (FIG. 3) and the first screen 212*a* at about 6.5 meters, and the second outflow hotspot 408*b* may be representative of fluid flow through the housing flow port 304 (FIG. 3) beneath the first housing 214*a* (FIG. 3) and the first screen 212*a*. As indicated, the radial peak velocity of the fluid 218 at the first outflow hotspot 408*a* is about 0.033 m/s, while the radial peak velocity of the fluid 218 at the second outflow hotspot 408*b* is about 0.03 m/s.

The plot 400 provides testing results that indicate that the screen assembly 300 that incorporates the peak flux reducing assembly 302 advantageously splits fluid flow hotspots into a plurality of hotspots, which correspondingly reduces the peak velocity of the fluid 218 entering and exiting the base pipe 202. By reducing the peak velocity, localized erosion of the screens 212*a,b* may be reduced, which may mitigate early failure of the screens 212*a,b*.

Figure 5:
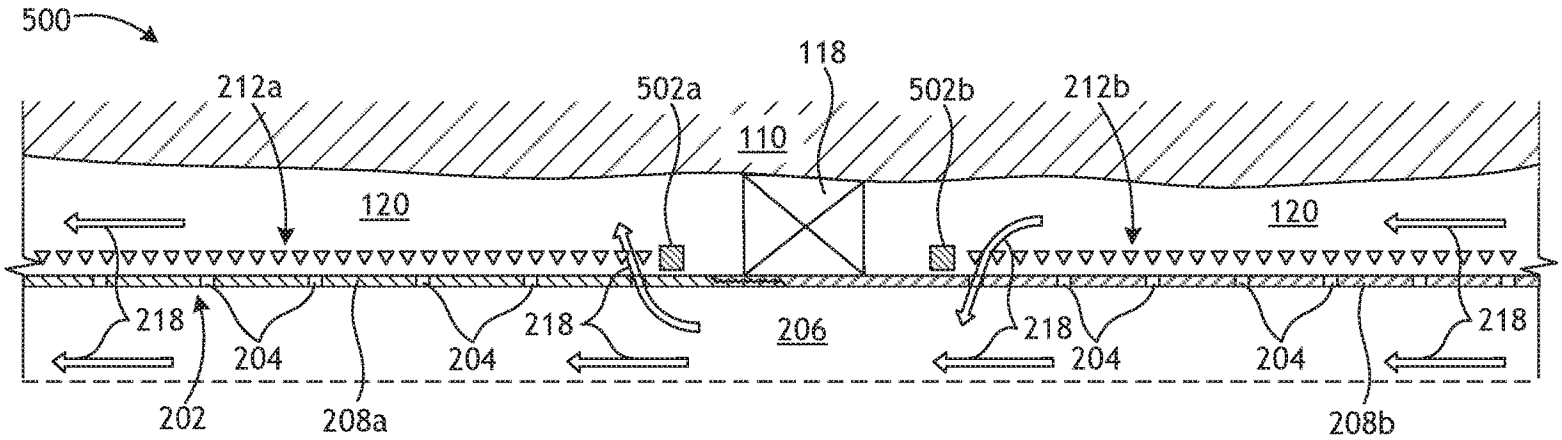
FIG. 5 is a cross-sectional side view of a sand control screen assembly.

FIG. 5 is a cross-sectional side view of another sand control screen assembly 500. The sand control screen assembly 500 (hereafter "the screen assembly 500") may be similar in some respects to the screen assemblies 200, 300 of FIGS. 2 and 3, respectively, and therefore may be best understood with reference thereto, where like numerals will represent like components not described again. Similar to the screen assemblies 200 and 300, the screen assembly 500 includes the base pipe 202 and the sand screens 212*a,b* are arranged about the base pipe 202.

Unlike the screen assemblies 200 and 300, however, the sand screens 212*a,b* may be wrapped directly onto the corresponding base pipe portions 208*a,b* such that no production annulus 216 (FIGS. 2 and 3) is provided. In other embodiments, however, the production annulus 216 may nonetheless be provided beneath one or both of the sand screens 212*a,b*. Moreover, the first and second and screens 212*a* may extend axially from corresponding first and second housings 502*a* and 502*b*, respectively. Similar to the housings 214*a,b* of FIGS. 2 and 3, the housings 502*a,b* provide a mechanical interface between the base pipe 202 and the corresponding first and second sand screens 212*a,b*. In other embodiments, however, one or both of the housings 502*a,b* may be omitted and the sand screens 212*a,b* may alternatively be welded or otherwise directly coupled to the base pipe 202.

Operation of the screen assembly 500 is substantially similar to operation of the screen assembly 200 of FIG. 2. More specifically, fluids 218 from the surrounding formation 110 may be drawn into the annulus 120 and circulated in the uphole direction (i.e., to the left in FIG. 5) within the annulus 120 and the interior 206 of the base pipe 202. In open hole applications, the fluid 218 will generally flow uphole in both the annulus 120 and the interior 206 of the base pipe 202. Upon approaching the wellbore isolation device 118, the fluid 218 flowing within the annulus 120 is forced through the second screen 212*b* at or near the second housing 502*b* and subsequently enters the base pipe 202 via the flow ports 204 axially adjacent the second housing 502*b*. Due to the dynamics of fluid flow, the fluid 218 from the annulus 120 is accelerated through the second screen 212*b* at peak velocity at or near the second housing 502*b*, which greatly accelerates the erosion of the screen 212*b* at this location.

Once bypassing the axial location of the wellbore isolation device 118 within the interior 206 of the base pipe 202, the flow of the fluid 218 will naturally tend to spread out (split) again to reduce (minimize) friction and pressure. Accordingly, a portion of the fluid 218 within the base pipe 202 may return to the annulus 120 by passing back out of the base pipe 202 and traversing the first screen 212*a* at or near the first housing 502*a*. The fluid 218 exiting the base pipe 202 and the first screen 212*a* may also be accelerated at peak velocity at or near the first housing 502*b*. Due to the peak velocity of the fluid 218 passing through the ends of the screens 212*a,b* near the housings 502*a,b*, localized fluid "hotspots" may develop and can result in erosional screen failure at these locations.

Figure 6:
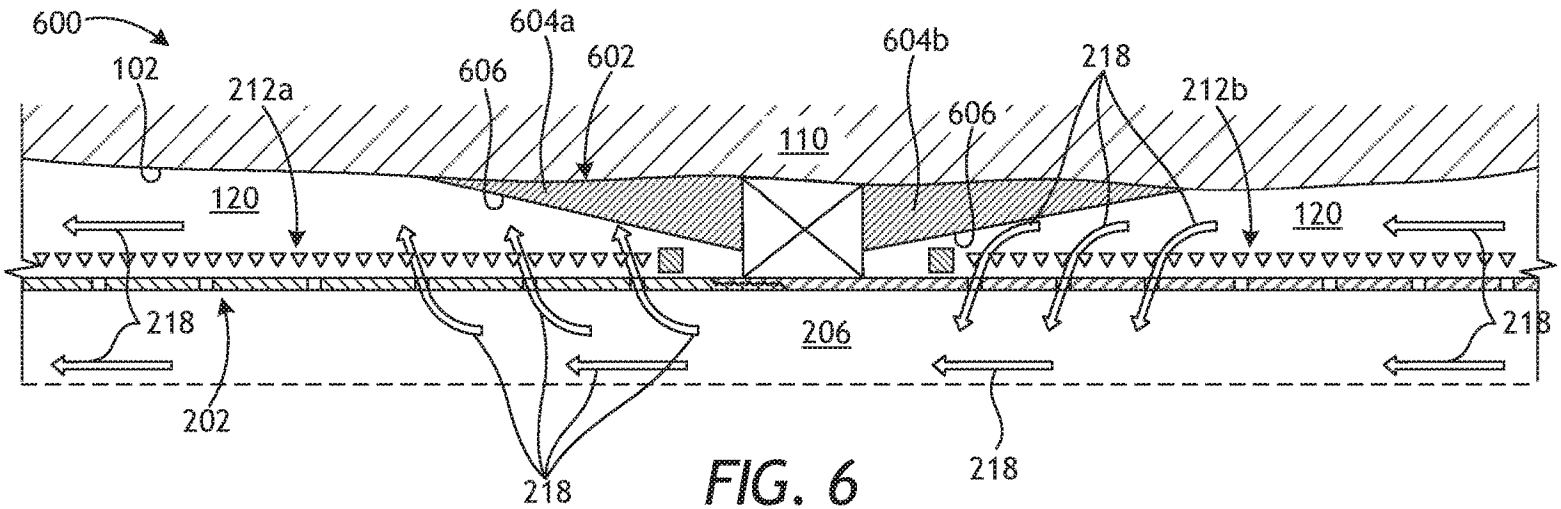
FIG. 6 is a cross-sectional side view of an example sand control screen assembly in accordance with one or more embodiments of the present disclosure.

FIG. 6 is a cross-sectional side view of an example sand control screen assembly 600 in accordance with one or more embodiments of the present disclosure. The sand control screen assembly 600 (hereafter "the screen assembly 600") may be similar to the screen assembly 500 of FIG. 5 and, therefore, may be best understood with reference thereto, where like numerals will represent like components not described again. The screen assembly 600 may replace any of the sand control screen assemblies 116 of FIG. 1 and, therefore, may be used in the well system 100 depicted therein. In at least one embodiment, the screen assembly 600 may be arranged at the end of the completion string 114 (FIG. 1) and otherwise comprise the last screen section at or near the toe of the wellbore 102. Moreover, the screen assembly 600 may be arranged in an open hole section of the wellbore 102, thus making the screen assembly 600 a standalone screen.

Similar to the screen assembly 500 of FIG. 5, the screen assembly 600 includes the base pipe 202 and the sand screens 212*a,b* are arranged about the base pipe 202 and extend axially from the corresponding housings 502*a,b*, respectively. Unlike the screen assembly 500, however, the screen assembly 600 may include a peak flux reducing assembly 602 arranged at or adjacent the wellbore isolation device 118 and operable to reduce a peak velocity of the fluid 218 traversing one or both of the sand screens 212*a,b*. In the illustrated embodiment, the peak flux reducing assembly 602 is operable to reduce the peak velocity of the fluid 218 traversing both sand screens 212*a,b* on either axial side of the wellbore isolation device 118, but could alternatively be operable to reduce the peak velocity of the fluid 218 traversing only one of the sand screens 212*a,b*, without departing from the scope of the disclosure.

As illustrated, the peak flux reducing assembly 602 may include a first or uphole flow diverter 604*a* that extends axially uphole from the wellbore isolation device 118 and second or downhole flow diverter 604*b* that extends downhole from the wellbore isolation device 118. In other embodiments, however, the peak flux reducing assembly 602 may include only one of the first or second flow diverters 604*a,b*, without departing from the scope of the disclosure. The peak flux reducing assembly 602 may operate to progressively reduce the volumetric flow area of the annulus 120 at the ends of the screens 212*a,b* axially adjacent the wellbore isolation device 118, which may spread the volumetric flow of the fluid 218 through the screens 212*a,b* (either influx or outflow) across a larger axial length (area).

In some embodiments, the peak flux reducing assembly 602 may comprise an integral part or extension of the wellbore isolation device 118. In such embodiments, deploying the wellbore isolation device 118 within the annulus 120 may simultaneously deploy the flow diverters 604*a,b* on one or both sides of the wellbore isolation device 118. Moreover, in such embodiments, the peak flux reducing assembly 602 may comprise an expandable or swellable material capable of creeping axially uphole and/or downhole to progressively reduce the volumetric flow area of the annulus 120. In other embodiments, the peak flux reducing assembly 602 may comprise a separate component or structure from the wellbore isolation device 118. In such embodiments, the peak flux reducing assembly 602 may be deployed simultaneously with the wellbore isolation device 118 or at a different time.

As illustrated, the peak flux reducing assembly 602 (i.e., the flow diverters 604*a,b*) may extend axially past the first and second housings 502*a,b* and radially above a portion of the sand screens 212*a,b* in either axial direction. Each flow diverter 604*a,b* may define or otherwise include a tapered or angled face 606 that extends from the wellbore isolation device 118 to the inner wall of the wellbore 102. In some embodiments, as illustrated, the angled face 606 may be continuous or straight. In other embodiments, however, the angled face 606 may be discontinuous (e.g., stepped, jagged, undulating, etc.) or otherwise non-linear, without departing from the scope of the disclosure. In some embodiments, the first and second flow diverters 604*a,b* may comprise solid structures. In other embodiments, however, the first and second flow diverters 604*a,b* may comprise hollow shell structures that nonetheless facilitate flow diversion.

In example operation, fluids 218 from the surrounding formation 110 may be drawn into the annulus 120 and then circulated in the uphole direction (i.e., to the left in FIG. 6) within the annulus 120 and the interior 206 of the base pipe 202. The fluid 218 may access the interior 206 by passing through the screens 212*a,b*, and since the screen assembly 600 is positioned in an open hole annulus 120, the fluid 218 will generally flow uphole simultaneously in both the annulus 120 and the interior 206 of the base pipe 202.

Upon approaching the wellbore isolation device 118 in the uphole direction, the fluid 218 in the annulus 120 will be diverted through the second screen 212*b* to enter the base pipe 202. The second flow diverter 604*b* may operate to progressively reduce the volumetric flow area of the annulus 120 near the wellbore isolation device 118 in the uphole direction. As a result, the flux of the fluid 218 may be forced into the base pipe 202 progressively, and not all at once at the end of the second sand screen 212*b*. Consequently, the fluid 218 may be urged through the second screen 212*b* across a larger (longer) axial length of the second screen 212*b* as compared to the embodiment of FIG. 5. More specifically, peak velocity of the fluid 218 traversing the second screen 212*b* may be less than the peak velocity of the fluid 218 traversing the second screen 212*b* in the embodiment of FIG. 5.

Once bypassing the axial location of the wellbore isolation device 118 within the interior 206 of the base pipe 202, the flow of the fluid 218 will naturally tend to spread out (split) again to reduce (minimize) friction and pressure. Accordingly, a portion of the fluid 218 may return to the annulus 120 by exiting the base pipe 202 through the first screen 212*a*. The first flow diverter 604*a* may progressively increase the volumetric flow area of the annulus 120 near the wellbore isolation device 118 in the uphole direction. As a result, the fluid 218 may be urged through the first screen 212*a* across a larger (longer) axial length of the first screen 212*a* as compared to the embodiment of FIG. 5. Consequently, the peak velocity of the fluid 218 traversing the first screen 212*a* may be less than the peak velocity of the fluid 218 traversing the first screen 212*a* in the embodiment of FIG. 5. By reducing the peak velocity of the fluid 218 entering and exiting the base pipe 202 at or near the ends of the screens 212*a,b*, localized erosion of the screens 212*a,b* may be drastically reduced, which may mitigate early failure of the screens 212*a,b*.

In some embodiments, the peak flux reducing assembly 602 may be tuned or otherwise optimized to adjust the influx and/or outflow of the fluid 218 through the sand screens 212*a,b*. In at least one embodiment, for example, the size and/or configuration of the first and/or second flow diverters 604*a,b* may be adjusted. In such embodiments, the axial length of one or both of the flow diverters 604*a,b* may be elongated or shortened, which may result in spreading the flow of the fluid 218 through the screens 212*a,b* over differing axial lengths. In other embodiments, the angled face 606 of one or both of the flow diverters 604*a,b* may be altered to adjust the back pressure of the fluid 218 within the annulus 120, which may correspondingly alter the flow area of the fluid through the screens 212*a,b*.

Adjustments to the size and/or configuration of the peak flux reducing assembly 602 may be based on various known parameters of the screen assembly 600. Example known parameters include, but are not limited to, one or more fluid properties of the fluid 218 (e.g., flow rate, viscosity, etc.), one or more geometric parameters of the well (e.g., diameter of the wellbore 102, etc.), one or more features of the screens 212*a,b* (e.g., size of the screens, height of the ribs, number of flow ports 204 in the base pipe 202, etc.), or any combination thereof.

Figure 7:
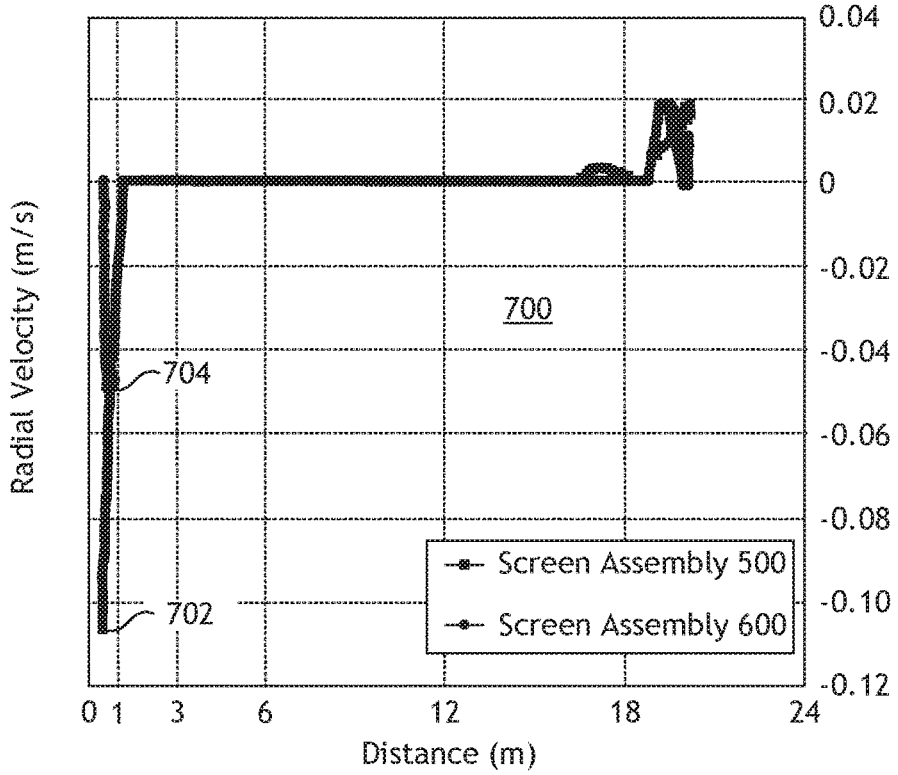
FIG. 7 is another plot comparing fluid flow through a conventional sand control screen assembly with fluid flow through a sand control screen assembly according to the principles of the present disclosure.

FIG. 7 is a plot 700 comparing fluid flow through the screen assembly 500 of FIG. 5 with fluid flow through the screen assembly 600 of FIG. 6 that incorporates the principles of the present disclosure. Accordingly, the plot 700 will be best understood with continued reference to FIGS. 5 and 6. As illustrated, the radial velocity of the fluid flow (in meters per second) is tracked based on distance (in meters) along the length of the base pipe 202 (FIGS. 5 and 6) for each screen assembly 500, 600. Only fluid flow through the second sand screen 212*b* is depicted in the plot 700.

For the screen assembly 500, the radial velocity of the fluid flow is generally zero (moving right to left, e.g., uphole flow) until reaching the end of the sand screen 212*b*, at which point the fluid rapidly accelerates radially through the second screen 212*b* (FIG. 5) and into the base pipe 202. This rapid fluid acceleration results in a single influx hotspot 702 for the influx of the fluid 218 (FIG. 5) through the second screen 212*b* at a radial peak velocity of about −0.11 m/s (negative since flow is into the base pipe 202). The fluid 218 accelerates through the sand screen 212*b* sharply at about 0.5 meters.

In contrast, for the screen assembly 600, flow through the second sand screen 212*b* (FIG. 6) is spread across a larger portion of the base pipe 202 (FIG. 6). More specifically, the radial velocity of the fluid flow is generally zero (moving right to left, e.g., uphole flow) until around 1.0 meters, at which point the fluid 218 (FIG. 6) starts to traverse radially through the second screen 212*b* and into the base pipe 202 (FIG. 6). As indicated in the plot 700, the fluid 218 traverses the second screen 212*b* between about 1.0 meters and about 0.5 meters, thus spreading the fluid flux across a larger portion of the second screen and resulting in an influx hotspot 704 through the second screen 212*b* at a radial peak velocity of about −0.05 m/s.

The plot 700 indicates that the screen assembly 600 advantageously spreads the fluid flow across a larger section of the base pipe 202, which correspondingly reduces the peak velocity of the fluid 218 entering the base pipe 202. By reducing the peak velocity of the fluid 218 entering the base pipe 202 localized erosion of the second screen 212*b* may be drastically reduced, which may mitigate early failure of the screen 212*b*.

While the foregoing description is directed generally to production operations, the principles of the present disclosure are equally applicable to injection operations. More specifically, fluids conveyed from a surface location to the screen assemblies 300, 600 of FIGS. 3 and 6, respectively, may be ejected into the surrounding annulus 120 through the upper and lower sand screens 212*a,b*. The flux reducing assemblies 302, 602 of FIGS. 3 and 6, respectively, may operate to reduce the peak velocity of the fluid injected into the annulus 120 at the ends of the sand screens 212*a,b*.

Moreover, while the flux reducing assemblies 302, 602 of FIGS. 3 and 6, respectively, are described herein as independently operable of one another, it is contemplated herein to combine the flux reducing assemblies 302, 602 in a common application. In such embodiments, the peak velocity of the fluid 218 entering and/or exiting the base pipe 202 may be reduced by urging the fluid 218 through the screens 212*a,b* at multiple locations while simultaneously urging the fluid 218 to traverse the screens 212*a,b* across a larger axial length of the screens 212*a,b* and thereby spread the volumetric flow over a larger area.

Embodiments disclosed herein include:

A. A method of reducing erosional peak velocity that includes arranging a sand control screen assembly in an open hole section of a wellbore, the sand control screen assembly including a base pipe defining a plurality of flow ports, a sand screen arranged about the base pipe, and a wellbore isolation device deployed within an annulus defined between the sand control screen assembly and an inner wall of the wellbore, circulating a fluid from a surrounding subterranean formation within the annulus, diverting the fluid through the sand screen and into the base pipe upon approaching the wellbore isolation device, and reducing a peak velocity of the fluid flowing through the sand screen with a peak flux reducing assembly arranged axially adjacent the wellbore isolation device.

B. A sand control screen assembly deployable within an open hole section of a wellbore and including a base pipe that defines a plurality of flow ports, a sand screen arranged about the base pipe, a wellbore isolation device deployable within an annulus defined between the sand control screen assembly and an inner wall of the wellbore, and a peak flux reducing assembly arranged axially adjacent the wellbore isolation device to reduce a peak velocity of fluids traversing the sand screen.

Each of embodiments A and B may have one or more of the following additional elements in any combination: Element 1: wherein the sand screen terminates at a housing arranged axially adjacent the wellbore isolation device, and the peak flux reducing assembly includes one or more housing flow ports defined in the base pipe radially beneath the housing and an impermeable section of the base pipe extends between the one or more housing flow ports and the plurality of flow ports, the method further comprising flowing a first incoming portion of the fluid through the sand screen at or near the plurality of flow ports nearest the housing, and flowing a second incoming portion of the fluid through the sand screen at or near the housing and through the one or more housing flow ports. Element 2: further comprising altering a flow rate of the first and second incoming portions of the fluid through the sand screen by adjusting at least one of i) a size of the one or more housing flow ports, and ii) an axial length of the impermeable section. Element 3: wherein the sand control screen assembly further includes a second sand screen arranged about the base pipe and terminating at a second housing arranged axially adjacent the wellbore isolation device, and wherein the peak flux reducing assembly further includes one or more second housing flow ports defined in the base pipe radially beneath the second housing and a second impermeable section of the base pipe extends between the one or more second housing flow ports and a second plurality of flow ports defined in the base pipe, the method further comprising flowing the fluid within the base pipe past an axial location of the wellbore isolation device, flowing a first exiting portion of the fluid out of the base pipe through the second sand screen via the one or more second housing flow ports, and flowing a second exiting portion of the fluid out of the base pipe through the second sand screen via the second plurality of flow ports nearest the second housing. Element 4: further comprising altering a flow rate of the first and second exiting portions of the fluid through the second sand screen by adjusting at least one of i) a size of the one or more second housing flow ports, and ii) an axial length of the second impermeable section. Element 5: wherein the peak flux reducing assembly includes a flow diverter extending axially from the wellbore isolation device and radially above an end of the sand screen within the annulus, and wherein the flow diverter progressively reduces a volumetric flow area of the annulus in an uphole direction at the end of the sand screen, the method further comprising impinging the fluid within the annulus on the flow diverter and thereby progressively urging the fluid through the sand screen along an axial length of the sand screen. Element 6: further comprising altering a flow rate of the fluid through the sand screen by adjusting at least one of i) a size of the flow diverter, ii) an axial length of the flow diverter, and iii) an angled face of the flow diverter. Element 7: wherein the sand control screen assembly further includes a second sand screen arranged about the base pipe axially adjacent the wellbore isolation device, and the peak flux reducing assembly further includes a second flow diverter extending axially from the wellbore isolation device and radially above an end of the second sand screen within the annulus, and wherein the second flow diverter progressively increases a volumetric flow area of the annulus in the uphole direction at the end of the second sand screen, the method further comprising flowing the fluid within the base pipe past an axial location of the wellbore isolation device, and flowing a portion of the fluid out of the base pipe through the second sand screen along an axial length of the second sand screen. Element 8: further comprising altering a flow rate of the fluid through the second and screen by adjusting at least one of i) a size of the second flow diverter, ii) an axial length of the second flow diverter, and iii) an angled face of the second flow diverter. Element 9: wherein circulating the fluid from the surrounding subterranean formation within the annulus comprises simultaneously circulating a portion of the fluid from the surrounding subterranean formation within the base pipe.

Element 10: wherein the peak flux reducing assembly comprises a housing arranged axially adjacent the wellbore isolation device, wherein the sand screen terminates at the housing, one or more housing flow ports defined in the base pipe radially beneath the housing, and an impermeable section of the base pipe extending between the one or more housing flow ports and the plurality of flow ports, wherein the impermeable section urges a first incoming portion of the fluid through the sand screen at or near the plurality of flow ports nearest the housing and a second incoming portion of the fluid through the sand screen at or near the housing and through the one or more housing flow ports. Element 11: wherein the impermeable section extends radially beneath a portion of the sand screen and radially beneath the housing. Element 12: wherein the sand control screen assembly further includes a second sand screen arranged about the base pipe and the peak flux reducing assembly further comprises a second housing arranged axially adjacent the wellbore isolation device, wherein the second sand screen terminates at the second housing, one or more second housing flow ports defined in the base pipe radially beneath the second housing, and a second impermeable section of the base pipe extending between the one or more second housing flow ports and a second plurality of flow ports defined in the base pipe. Element 13: wherein the second impermeable section extends radially beneath a portion of the second sand screen and radially beneath the second housing. Element 14: wherein the peak flux reducing assembly comprises a flow diverter extending from the wellbore isolation device radially above an end of the sand screen within the annulus, and wherein the flow diverter progressively reduces a volumetric flow area of the annulus in an uphole direction at the end of the sand screen. Element 15: wherein the sand control screen assembly further includes a second sand screen arranged about the base pipe axially adjacent the wellbore isolation device, and the peak flux reducing assembly further comprises a second flow diverter extending from the wellbore isolation device radially above an end of the second sand screen within the annulus, wherein the second flow diverter progressively increases a volumetric flow area of the annulus in the uphole direction at the end of the second sand screen. Element 16: wherein the peak flux reducing assembly comprises a housing arranged axially adjacent the wellbore isolation device, wherein the sand screen terminates at the housing, one or more housing flow ports defined in the base pipe radially beneath the housing, an impermeable section of the base pipe extending between the one or more housing flow ports and the plurality of flow ports, and a flow diverter extending from the wellbore isolation device radially above an end of the sand screen within the annulus. Element 17: further comprising a second sand screen arranged about the base pipe, wherein the peak flux reducing assembly further comprises a second housing arranged axially adjacent the wellbore isolation device, wherein the second sand screen terminates at the second housing, one or more second housing flow ports defined in the base pipe radially beneath the second housing, a second impermeable section of the base pipe extending between the one or more second housing flow ports and a second plurality of flow ports defined in the base pipe, and a second flow diverter extending from the wellbore isolation device radially above an end of the second sand screen within the annulus.

By way of non-limiting example, exemplary combinations applicable to A and B include: Element 1 with Element 2; Element 1 with Element 3; Element 3 with Element 4; Element 5 with Element 6; Element 5 with Element 7; Element 7 with Element 8; Element 10 with Element 11; Element 10 with Element 12; Element 12 with Element 13; Element 14 with Element 15; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method of reducing erosional peak velocity, comprising:

arranging a sand control screen assembly in an open hole section of a wellbore, the sand control screen assembly including a base pipe defining a plurality of flow ports, a sand screen arranged about the base pipe, and a wellbore isolation device deployed within an annulus defined between the sand control screen assembly and an inner wall of the wellbore;

circulating a fluid from a surrounding subterranean formation within the annulus;

diverting the fluid through the sand screen and into the base pipe upon approaching the wellbore isolation device; and reducing a peak velocity of the fluid flowing through the sand screen with a peak flux reducing assembly arranged axially adjacent the wellbore isolation device, wherein the peak flux reducing assembly includes a flow diverter extending axially from the wellbore isolation device and radially above an end of the sand screen within the annulus, and wherein the flow diverter progressively reduces a volumetric flow area of the annulus in an uphole direction at the end of the sand screen, the method further comprising:

impinging the fluid within the annulus on the flow diverter and thereby progressively urging the fluid through the sand screen along an axial length of the sand screen.

2. The method of claim 1, wherein the sand screen terminates at a housing arranged axially adjacent the wellbore isolation device, and the peak flux reducing assembly includes one or more housing flow ports defined in the base pipe radially beneath the housing and an impermeable section of the base pipe extends between the one or more housing flow ports and the plurality of flow ports, the method further comprising:

flowing a first incoming portion of the fluid through the sand screen at or near the plurality of flow ports nearest the housing; and flowing a second incoming portion of the fluid through the sand screen at or near the housing and through the one or more housing flow ports.

3. The method of claim 2, further comprising altering a flow rate of the first and second incoming portions of the fluid through the sand screen by adjusting at least one of i) a size of the one or more housing flow ports, and ii) an axial length of the impermeable section.

4. The method of claim 2, wherein the sand control screen assembly further includes a second sand screen arranged about the base pipe and terminating at a second housing arranged axially adjacent the wellbore isolation device, and wherein the peak flux reducing assembly further includes one or more second housing flow ports defined in the base pipe radially beneath the second housing and a second impermeable section of the base pipe extends between the one or more second housing flow ports and a second plurality of flow ports defined in the base pipe, the method further comprising:

flowing the fluid within the base pipe past an axial location of the wellbore isolation device;

flowing a first exiting portion of the fluid out of the base pipe through the second sand screen via the one or more second housing flow ports; and flowing a second exiting portion of the fluid out of the base pipe through the second sand screen via the second plurality of flow ports nearest the second housing.

5. The method of claim 4, further comprising altering a flow rate of the first and second exiting portions of the fluid through the second sand screen by adjusting at least one of i) a size of the one or more second housing flow ports, and ii) an axial length of the second impermeable section.

6. The method of claim 1, further comprising altering a flow rate of the fluid through the sand screen by adjusting at least one of i) a size of the flow diverter, ii) an axial length of the flow diverter, and iii) an angled face of the flow diverter.

7. The method of claim 1, wherein the sand control screen assembly further includes a second sand screen arranged about the base pipe axially adjacent the wellbore isolation device, and the peak flux reducing assembly further includes a second flow diverter extending axially from the wellbore isolation device and radially above an end of the second sand screen within the annulus, and wherein the second flow diverter progressively increases a volumetric flow area of the annulus in the uphole direction at the end of the second sand screen, the method further comprising:

flowing the fluid within the base pipe past an axial location of the wellbore isolation device; and flowing a portion of the fluid out of the base pipe through the second sand screen along an axial length of the second sand screen.

8. The method of claim 7, further comprising altering a flow rate of the fluid through the second and screen by adjusting at least one of i) a size of the second flow diverter, ii) an axial length of the second flow diverter, and iii) an angled face of the second flow diverter.

9. The method of claim 1, wherein circulating the fluid from the surrounding subterranean formation within the annulus comprises simultaneously circulating a portion of the fluid from the surrounding subterranean formation within the base pipe.

10. A sand control screen assembly deployable within an open hole section of a wellbore, comprising:

a base pipe that defines a plurality of flow ports;

a sand screen arranged about the base pipe;

a wellbore isolation device deployable within an annulus defined between the sand control screen assembly and an inner wall of the wellbore; and a peak flux reducing assembly arranged axially adjacent the wellbore isolation device to reduce a peak velocity of fluids traversing the sand screen, wherein the peak flux reducing assembly comprises a flow diverter extending from the wellbore isolation device radially above an end of the sand screen within the annulus, and wherein the flow diverter progressively reduces a volumetric flow area of the annulus in an uphole direction at the end of the sand screen.

11. The sand control screen assembly of claim 10, wherein the peak flux reducing assembly comprises:

a housing arranged axially adjacent the wellbore isolation device, wherein the sand screen terminates at the housing;

one or more housing flow ports defined in the base pipe radially beneath the housing; and an impermeable section of the base pipe extending between the one or more housing flow ports and the plurality of flow ports, wherein the impermeable section urges a first incoming portion of the fluid through the sand screen at or near the plurality of flow ports nearest the housing and a second incoming portion of the fluid through the sand screen at or near the housing and through the one or more housing flow ports.

12. The sand control screen assembly of claim 11, wherein the impermeable section extends radially beneath a portion of the sand screen and radially beneath the housing.

13. The sand control screen assembly of claim 11, wherein the sand control screen assembly further includes a second sand screen arranged about the base pipe and the peak flux reducing assembly further comprises:

a second housing arranged axially adjacent the wellbore isolation device, wherein the second sand screen terminates at the second housing;

one or more second housing flow ports defined in the base pipe radially beneath the second housing; and a second impermeable section of the base pipe extending between the one or more second housing flow ports and a second plurality of flow ports defined in the base pipe.

14. The sand control screen assembly of claim 13, wherein the second impermeable section extends radially beneath a portion of the second sand screen and radially beneath the second housing.

15. The sand control screen assembly of claim 10, wherein the sand control screen assembly further includes a second sand screen arranged about the base pipe axially adjacent the wellbore isolation device, and the peak flux reducing assembly further comprises:

a second flow diverter extending from the wellbore isolation device radially above an end of the second sand screen within the annulus, wherein the second flow diverter progressively increases a volumetric flow area of the annulus in the uphole direction at the end of the second sand screen.

16. The sand control screen assembly of claim 10, wherein the peak flux reducing assembly comprises:

a housing arranged axially adjacent the wellbore isolation device, wherein the sand screen terminates at the housing;

one or more housing flow ports defined in the base pipe radially beneath the housing;

an impermeable section of the base pipe extending between the one or more housing flow ports and the plurality of flow ports; and a flow diverter extending from the wellbore isolation device radially above an end of the sand screen within the annulus.

17. The sand control screen assembly of claim 16, further comprising a second sand screen arranged about the base pipe, wherein the peak flux reducing assembly further comprises:

a second housing arranged axially adjacent the wellbore isolation device, wherein the second sand screen terminates at the second housing;

one or more second housing flow ports defined in the base pipe radially beneath the second housing;

a second impermeable section of the base pipe extending between the one or more second housing flow ports and a second plurality of flow ports defined in the base pipe; and a second flow diverter extending from the wellbore isolation device radially above an end of the second sand screen within the annulus.

18. A sand control screen assembly deployable within an open hole section of a wellbore, comprising:

a base pipe that defines a plurality of flow ports;

a sand screen arranged about the base pipe;

a wellbore isolation device deployable within an annulus defined between the sand control screen assembly and an inner wall of the wellbore; and a peak flux reducing assembly arranged axially adjacent the wellbore isolation device to reduce a peak velocity of fluids traversing the sand screen, wherein the peak flux reducing assembly comprises:

a housing arranged axially adjacent the wellbore isolation device, wherein the sand screen terminates at the housing;

one or more housing flow ports defined in the base pipe radially beneath the housing;

an impermeable section of the base pipe extending between the one or more housing flow ports and the plurality of flow ports; and a flow diverter extending from the wellbore isolation device radially above an end of the sand screen within the annulus.

* * * * *